US011441278B2

(12) United States Patent
Minor et al.

(10) Patent No.: US 11,441,278 B2
(45) Date of Patent: Sep. 13, 2022

(54) BREAKAWAY CLAMP FOR ROADSIDE POLE

(71) Applicant: Kearney-National Inc., New York, NY (US)

(72) Inventors: Ray C. Minor, Abingdon, VA (US); Gregory David Mercier, Bristol, VA (US)

(73) Assignee: KEARNEY-NATIONAL INC., New York, NY (US)

( * ) Notice: Subject to any disclaimer, the term of this patent is extended or adjusted under 35 U.S.C. 154(b) by 975 days.

(21) Appl. No.: 16/188,540

(22) Filed: Nov. 13, 2018

(65) Prior Publication Data

US 2019/0145069 A1 May 16, 2019

Related U.S. Application Data

(60) Provisional application No. 62/587,085, filed on Nov. 16, 2017.

(51) Int. Cl.
*E01F 9/635* (2016.01)
*E01F 9/681* (2016.01)

(52) U.S. Cl.
CPC ..... *E01F 9/635* (2016.02); *E01F 9/681* (2016.02)

(58) Field of Classification Search
CPC ..... E01F 9/631; E01F 9/635; E01F 9/681
See application file for complete search history.

(56) References Cited

U.S. PATENT DOCUMENTS

| | | | | |
|---|---|---|---|---|
| 3,987,593 | A * | 10/1976 | Svensson | E01F 9/631 52/843 |
| 4,738,058 | A * | 4/1988 | Svensson | F21V 21/10 52/843 |
| 6,056,471 | A | 5/2000 | Dinitz | |
| 7,195,222 | B2 * | 3/2007 | Dent | E01F 9/635 248/519 |
| 8,215,084 | B2 | 7/2012 | Bowman et al. | |
| 2011/0067323 | A1 * | 3/2011 | Mercier | E01F 9/635 52/98 |

* cited by examiner

*Primary Examiner* — Gary S Hartmann
(74) *Attorney, Agent, or Firm* — Buchanan Ingersoll & Rooney PC

(57) ABSTRACT

A breakaway pole including an elongated pole body extending between a bottom end and an upper end and a base connected to the bottom end of the elongated pole body. The base includes an interior flange having at least one slot. The breakaway pole includes a breakaway clamp mounted on the at least one slot of the interior flange of the base. The breakaway clamp includes a nut and a clamp body. The clamp body has a tapered main body and two lateral breakaway flanges. The lower portion of the tapered main body is positioned within the slot of the interior flange of the base. The two lateral breakaway flanges extend laterally outward from the upper portion of the tapered main body so that the two lateral breakaway flanges contact the interior flange of the base laterally beyond the at least one slot.

11 Claims, 5 Drawing Sheets

BREAKAWAY CLAMP FOR ROADSIDE POLE

CROSS-REFERENCES TO RELATED APPLICATIONS

This application claims the benefit under 35 U.S.C. § 119(e) of U.S. Provisional Application No. 62/587,085 filed on Nov. 16, 2017, the entire content of which is incorporated herein by reference.

TECHNICAL FIELD

The present disclosure relates to a breakaway apparatus (e.g., a breakaway clamp) and a roadside structure having a breakaway apparatus.

BACKGROUND

Utility poles, lighting poles, roadside signs, and other roadside structures may be mounted along highways and roadways. These roadside fixtures are typically mounted on and/or supported by a base (i.e., a foundation), such as a concrete base. Mounting each roadside structure includes several important design considerations.

Roadside structures must be capable of withstanding natural forces that will be imparted on the structures throughout the lifecycle of the pole, sign, etc. For example, roadside structures must be able to withstand external forces applied by wind and snow. More specifically, roadside structures must be adequately designed to withstand axial loading (i.e., tensile strength) and rotational loading (i.e., shear strength). The elongated nature of roadside poles particularly requires careful design considerations in ensuring that the connection between the pole and the foundation is adequate, as well as ensuring the pole material itself is capable of withstanding the expected forces.

Another important consideration in designing roadside structures is to prevent vehicle and/or passenger damage as much as possible in the event of a collision. For example, a vehicle traveling off the highway or roadway may directly contact a roadside structure. If the roadside structure is not readily severed from the base (or otherwise ruptured/severed), the amount of force imparted on the vehicle (and thus occupants in the vehicle) can be significant. Therefore, safety standards govern the design of roadway structures to help ensure that the roadside structures adequately sever or rupture in the event of, for example, a car accident.

For example, roadside structure design may be required to conform to the safety standards set forth in: (i) *Recommended Procedures for the Safety Performance Evaluation of Highway Features*, National Cooperative Highway Research Program Report 350; and/or (ii) *Manual for Assessing Safety Hardware*, American Association of State Highway and Transportation Officials.

Designing roadside structures thus involves balancing two contrasting concerns. That is, the roadside structure must be capable of withstanding natural forces such as wind and snow, while also being designed to breakaway (e.g., sever, rupture, or deflect) when a vehicle contacts the pole at a certain speed.

There are a few known ways to design roadside light poles to try to address both of these concerns. For example, U.S. Pat. No. 6,056,471 discloses a break-away coupling that extends between the base and the light pole. The break-away coupling includes two controlled breaking regions, so that a collision force will be absorbed to sever the pole in a controlled manner.

Another roadside pole design example is disclosed in U.S. Pat. No. 8,215,084. This utility pole includes an upper pole piece and a lower pole piece. The lower pole piece is embedded below the ground surface. The upper and lower pole pieces are connected by a weld joint, which creates a breakaway zone enabling the upper pole piece to break off from the lower pole piece when sufficient force (e.g., from a vehicle) is applied.

Another known roadside pole design involves using a nut and washer inside of the cylindrical base of the roadside pole. The nut and washer configuration, however, has shown to be unreliable in complying with the applicable roadside pole regulations.

The known roadside pole designs, such as those discussed above, can be improved upon. The breakaway properties of these poles may not be sufficiently reliable based on the designs. The known designs may also be improved upon by a design that improves manufacturability of the base and/or pole of the roadside structure. Furthermore, the break-away coupling and the external weld joint may deteriorate the aesthetic properties of the lighting pole (e.g., the break-away coupling may require an extension from the base and the external weld joint may be visible). As a final point, the existing configuration/design of the base or foundation of many roadside lighting poles may not be compatible with the types of designs discussed above. It would thus be helpful to provide a breakaway apparatus that may be compatible with existing roadside light poles.

SUMMARY

The present disclosure provides a description of roadside structure that includes an elongated pole body extending between a bottom end to an upper end and a base connected to the bottom end of the elongated pole body. The base includes an interior flange having at least one slot. The roadside structure also includes a breakaway clamp mounted on the at least one slot of the interior flange of the base. The breakaway clamp includes a nut and a clamp body. The clamp body has a tapered main body and two lateral breakaway flanges. The tapered main body possesses an upper portion and a lower portion. The lower portion of the tapered main body is positioned within the slot of the interior flange of the base. The two lateral breakaway flanges extend laterally outward from the upper portion of the tapered main body so that the two lateral breakaway flanges contact the interior flange of the base laterally beyond the at least one slot.

DETAILED DESCRIPTION

The components and devices described herein are in relation to a roadside structure. However, the components and devices are not necessarily limited to being used "roadside" (i.e., adjacent to a road or highway). Additionally, the description may be in relation to a roadside lighting pole, but the components and devices are not limited to a roadside lighting pole. The inventive breakaway apparatus may be used in any appropriate structure (e.g., fixture) as one of ordinary skill in the art would recognize.

Depending on implementation, the devices described herein may conform to the requirements of *Recommended Procedures for the Safety Performance Evaluation of Highway Features*, National Cooperative Highway Research Program Report 350 and/or *Manual for Assessing Safety Hardware*, American Association of State Highway and Transportation Officials. The scope of the appended claims, however, is not limited to conforming to any particular standards or requirements unless specifically recited in the claims.

Figure 1A:
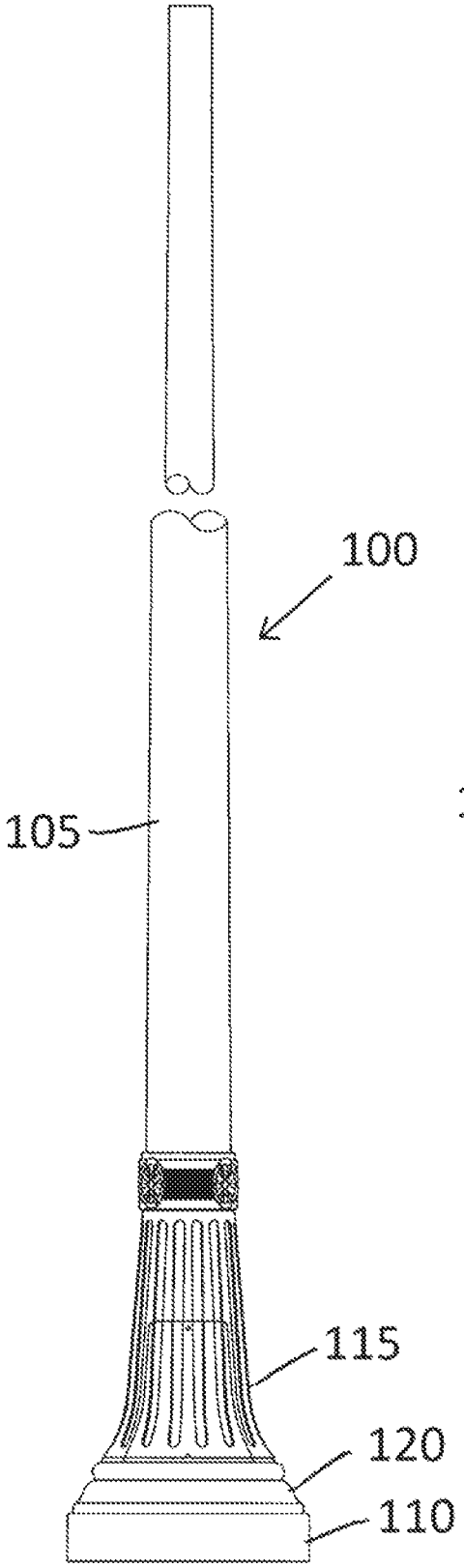
FIG. 1A illustrates a front view of an embodiment of a roadside structure.

FIG. 1A depicts a light pole 100, which is an example of a roadside structure. The light pole 100 includes an elongated pole body 105. The pole body 105 is tapered from the bottom end of the pole body 105 to the top end of the pole body. That is, the outer diameter of the pole body 105 is largest at the bottom end and gradually decreases towards the top end of the pole body 105. For example, the outer diameter of the pole body 105 may gradually decrease from 6.0" at the bottom end to 3.0" at the upper end. The pole body 105 may be any height, for example, between 10 and 20 feet tall. In some specific embodiments, the pole body 105 may be 17'-3" in length.

The pole body 105 is shown with a separation for convenience of illustrating the bottom and top portions of the pole body 105, but the pole body 105 would typically be continuous (and continuously tapered). In some embodiments, however, the pole body 105 could include two or more pole sections that are joined together to form the pole body 105.

The bottom end of the pole body 105 is connected to a base 110 (i.e., a base element or a base member). The base 110 may be a cylindrical body or could be any other non-cylindrical shape. The base 110 may be manufactured using aluminum or any other suitable material. The connection between the bottom end of the pole body 105 and the base 110 may be facilitated by a pedestal base body 115 and/or a tapered base section 120. In other words, the pole body 105 may be directly connected to the base 110 or may be connected to the base 110 via one or more additional components, such as the pedestal base body 115 or tapered base section 120.

Figure 1B:
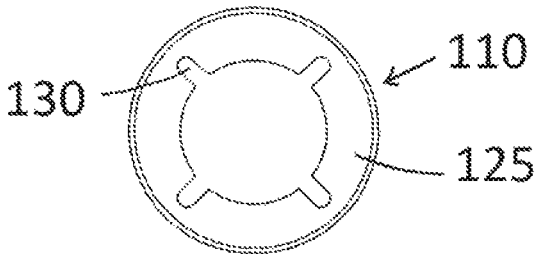
FIG. 1B illustrates a top view of an embodiment of a base of the roadside member.

FIG. 1B illustrates a top view (plan view) of the base 110. The base 110 may include an interior flange 125 that extends towards the interior of the light pole 100. The interior flange 125 may be provided at the top of the base 110, but the configuration is not limited in this respect. The interior flange 125 may extend around the entirety of the inner periphery of the base 110 or may extend only partially around the inner periphery of the base 110. The flange 125 may have the same shape as the interior of the base 110 (e.g., circular or ovular). The interior flange 125 of the base 110 may have one or more slots 130. For example, FIG. 1B illustrates an embodiment with four slots 130.

The slots 130 may be u-shaped, with parallel edges that are connected by a u-shaped (or curved or arced) portion. The slots 130 may be provided at the radially innermost section of the interior flange 125 so that there is an open portion at the innermost surface of the interior flange 125. In other embodiments, however, the slots 130 may be apertures or holes extending through a different portion of the interior flange 125. When more than one slot 130 is provided in the interior flange 125 of the base 110, the slots 130 may be equally spaced apart from one another in the circumferential direction around the interior flange 125 as shown in FIG. 1B.

In some known bases 110 of light poles 100, the slots 130 are specifically sized to be 1¼" wide and possess a length of 2⅛". In other bases 110, the slot 130 may be 1.20" wide. The dimensions discussed below for aspects of the breakaway clamp 300 may be specifically configured for interfacing with these slot dimensions. However, the inventive breakaway clamp and/or base of the roadside structure are not limited to possessing any specific dimensions.

Figure 2:
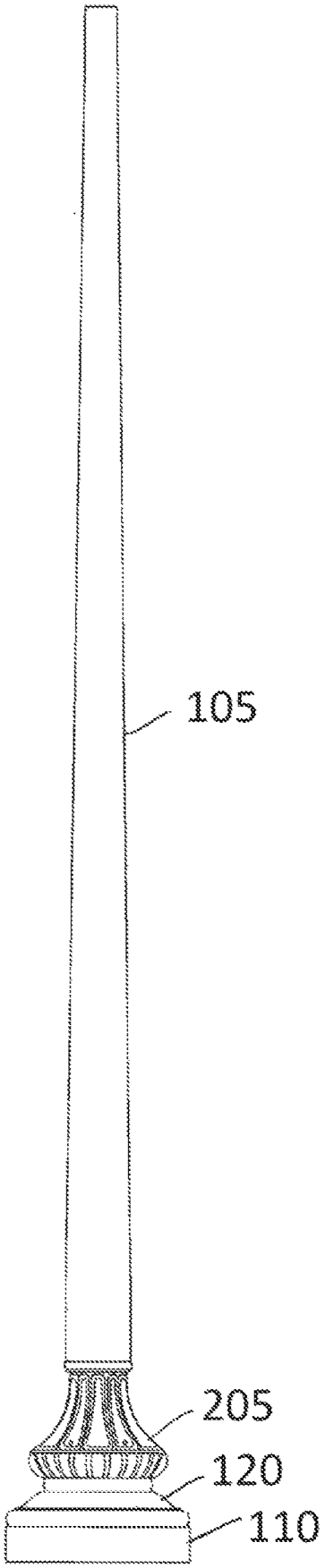
FIG. 2 illustrates a front view of another embodiment of a roadside structure.

FIG. 2 illustrates another embodiment of a light pole 200. This light pole 200 also includes an elongated pole body 105 and a base 110. The pole body 105 is connected to the base 110 via a high door opening 205 and a tapered base section 120. The pole body 105 in this embodiment may be between 10 and 20 feet tall. For example, the pole body 105 may be 18'-5" tall. The pole body 105 may gradually taper from an outer diameter of 5.8" at the bottom end to an outer diameter of 3.0" at the upper end. However, the pole body 105 is not limited to any specific dimensions. The configurations and variations of the pole body 105 and the base 110 of the light pole 200 illustrated in FIG. 2 may be similar to those discussed above, so additional discussion is not warranted.

The components discussed above of the light pole 100 and light pole 200 are preferably formed out of aluminum (e.g., alloy 6063-T6 or cast aluminum alloy 356-T6). The light pole 100 material(s), however, are not limited to any specific material or alloy.

Figure 3A:
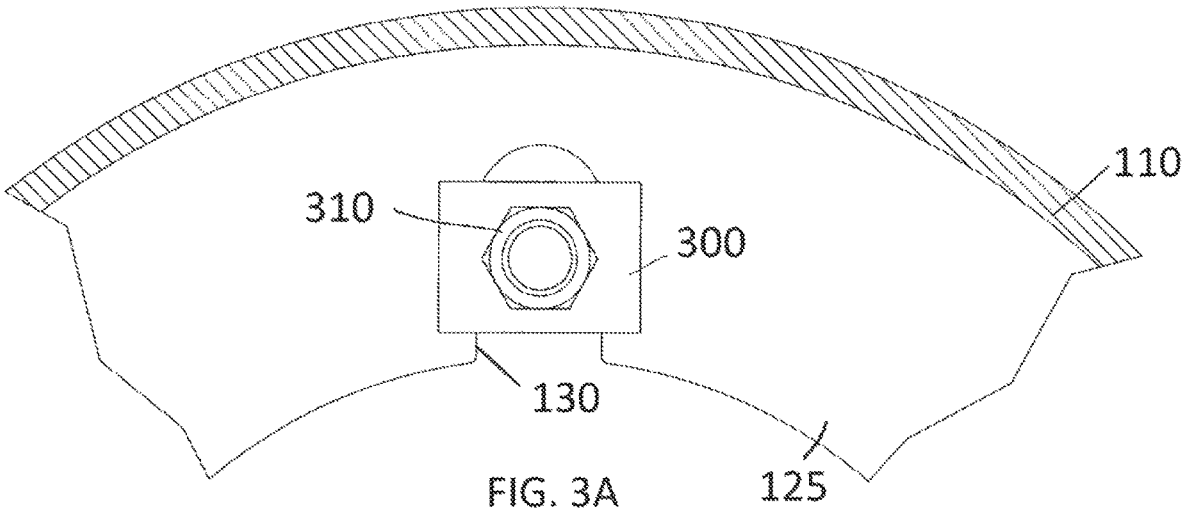
FIG. 3A illustrates a top view of a portion of the base of the roadside structure with an embodiment of a breakaway clamp mounted on the base.
Figure 3B:
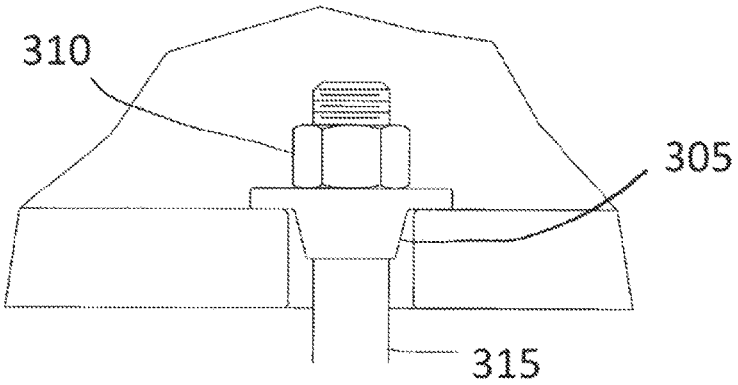
FIG. 3B illustrates a front view of the embodiment of the base and breakaway clamp shown in FIG. 3A.

FIGS. 3A and 3B illustrate an embodiment of a breakaway clamp 300 mounted on the base 110 of the light pole 100. More specifically, FIG. 3A illustrates a portion of the interior flange 125 of the base 110. The portion illustrated includes one slot 130. FIG. 3B shows a front view of the breakaway clamp 300 mounted in FIG. 3A.

The description of the breakaway clamp 300 is best understood when considering the collective depictions of FIGS. 3A-5B. The breakaway clamp 300 includes a clamp body 305 and a nut 310. The nut 310 may be a hex nut in some embodiments. The nut 310 is screwed onto an anchor bolt 315 that extends through a thru-hole 420 of the clamp body 305 as illustrated in FIG. 3B. The anchor bolt 315 includes external threads which threadedly engage with the internal threads of the nut 310. In this configuration, the anchor bolt 315 extends from below the clamp body 305, through the interior of the clamp body 305, and upwards beyond the clamp body 305. The anchor bolt 315 thus also extends from below the slot 130 of the interior flange 125 of the base 110 to above the slot 130.

Figure 4A:
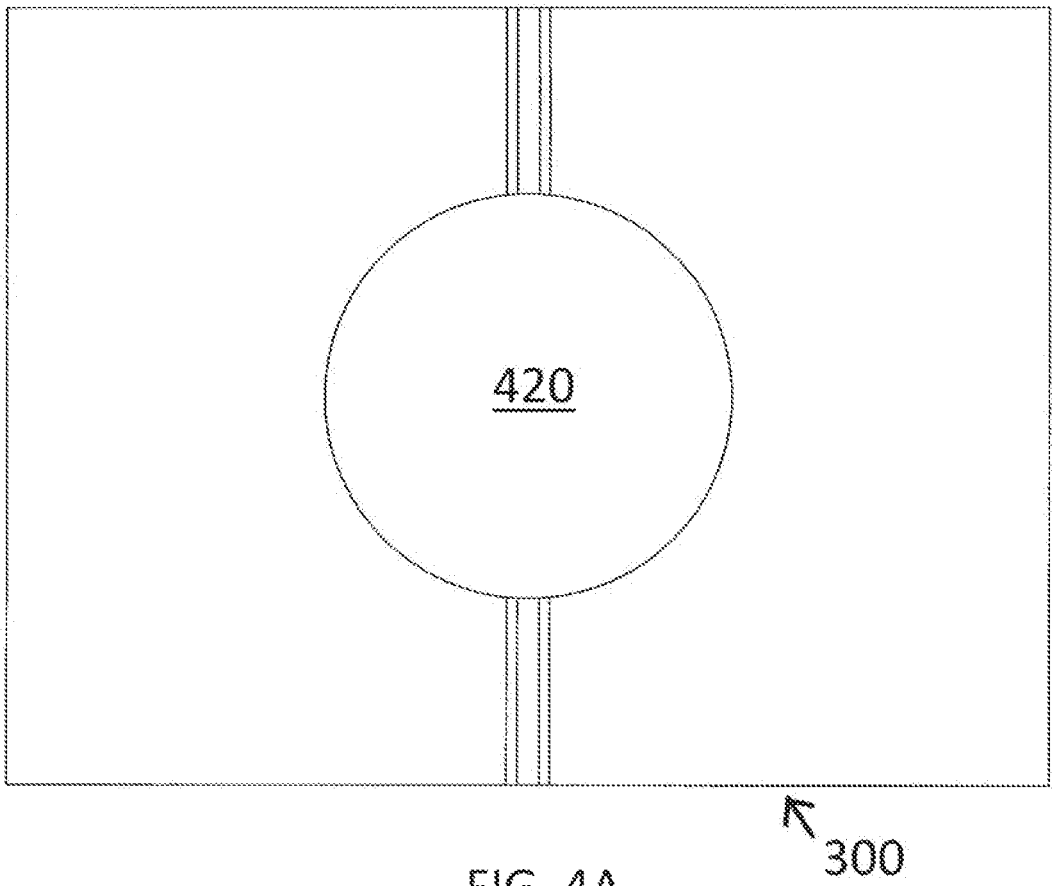
FIG. 4A illustrates a top view of an embodiment of the clamp body of the breakaway clamp.
Figure 4B:
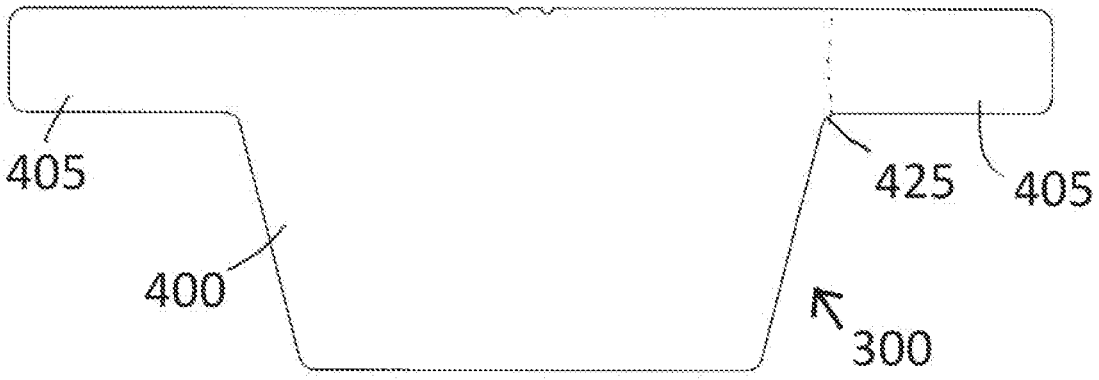
FIG. 4B illustrates a front view of the embodiment of the clamp body shown in FIG. 4A.

The features of the clamp body 305 may be best understood based on the depiction in FIG. 4B. The clamp body 305 includes a tapered main body 400 and two lateral breakaway flanges 405. The tapered main body 400 may have an outer dimension that gradually increases from the lower-most edge of the tapered main body 400 to the upper-most edge of the tapered main body 400, as illustrated in FIGS. 3B and 4B. The tapered main body 400 may be any type of polytope or polyhedron or could be frusto-conically shaped (i.e., shaped like the frustum of a cone). In some embodiments, the tapered main body 400 may be a truncated convex polytope as illustrated in FIG. 4B.

As shown in FIG. 4A, the tapered main body 400 includes a thru-hole 420 extending fully through the tapered main body 400. The thru-hole 420 receives the anchor bolt 315 (i.e., the anchor bolt 315 passes inside of and through the thru-hole 420 of the tapered main body 400). The thru-hole 420 is preferably a central bore, i.e., positioned in the center of the tapered main body 400 as shown in FIG. 4A. The thru-hole 420 could be offset from the center if desired in some embodiments. The thru-hole 420 may possess an inner diameter of any appropriate dimension. In some embodiments, the inner diameter of the thru-hole 420 of the clamp body 305 may be less than 1", for example, 25/32". FIGS. 4A and 4B also illustrate two grooves in the upper surface of the clamp body 305. Some embodiments of the clamp body 305, however, may not include grooves.

As shown in FIG. 3B, when the breakaway clamp 300 is mounted on the base 110, a portion (the majority) of the tapered main body 400 is positioned within the slot 130 of the interior flange 125 of the base 110. In some embodiments, the tapered main body 400 could extend below the slot 130 (i.e., below the interior flange 125). A portion of the anchor bolt 315 is positioned within the thru-hole 420 and is thus also within the slot 130.

The two lateral breakaway flanges 405 are provided at the top portion of the tapered main body 400 to extend laterally outward beyond the radially outermost edge of the tapered main body 400. The tapered main body 400 and the two lateral breakaway flanges 405 may be integrally formed at one time as a unitary structure. In other words, the clamp body 305 may be formed as a unitary piece, for example, by casting or extrusion. In other embodiments, the two lateral breakaway flanges 405 may be formed separately from the tapered main body 400 and then joined to the tapered main body 400 (e.g., by welding).

The clamp body 305 material may be aluminum or an aluminum alloy. In some embodiments, the clamp body 305 may be extruded aluminum alloy 6061-T6. However, the clamp body 305 is not limited to being formed out of any specific material.

The outermost width of the tapered main body 400 of the clamp body 300 is preferably smaller than the width of the slot 130 (or inner diameter of the slot 130 if the slot is a circular hole). FIG. 3B illustrates an example of the tapered main body 400 having an outermost diameter smaller than the width of the slot 130. The lateral breakaway flanges 405 extending from the tapered main body 400, however, possess an outer diameter that is greater than the width (or inner diameter) of the slot 130. The lateral breakaway flanges 405 thus extend laterally beyond the outer edges of the slot 130 on either side of the slot 130 as shown in FIG. 3B. As further shown in FIG. 3B, the lateral breakaway flanges 405 are thus in direct contact with the upper surface of the interior flange 125 of the base 110 in the portions immediately adjacent to the slot 130.

The connection between the tapered main body 400 and each of the lateral breakaway flanges 405 may be curved. More specifically, the connection area 425 may be a fillet (i.e., a rounding of the interior corner) as shown in FIG. 4B. For example, the connection area 425 could be a 1/32" fillet or 1/16" fillet. The connection area 425 could also be chamfered, inclined, or formed in any other manner. Forming the connection area 425 as a fillet, however, may help provide beneficial breakaway properties to allow the lateral breakaway flanges 405 to separate from the tapered main body 400 (as further discussed below).

Figure 5A:
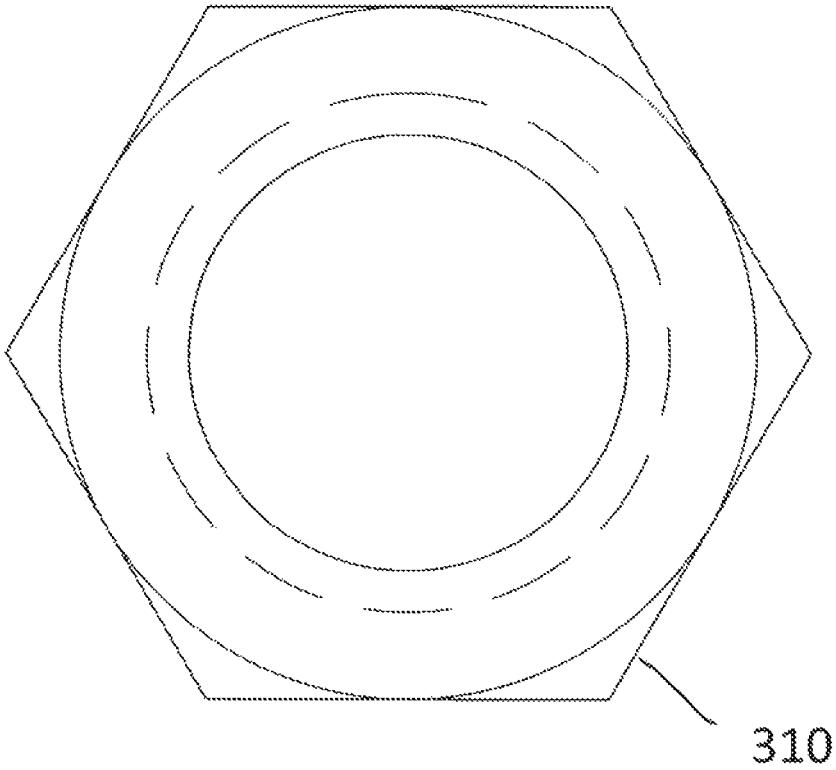
FIG. 5A illustrates a top view of an embodiment of a nut of the breakaway clamp.
Figure 5B:
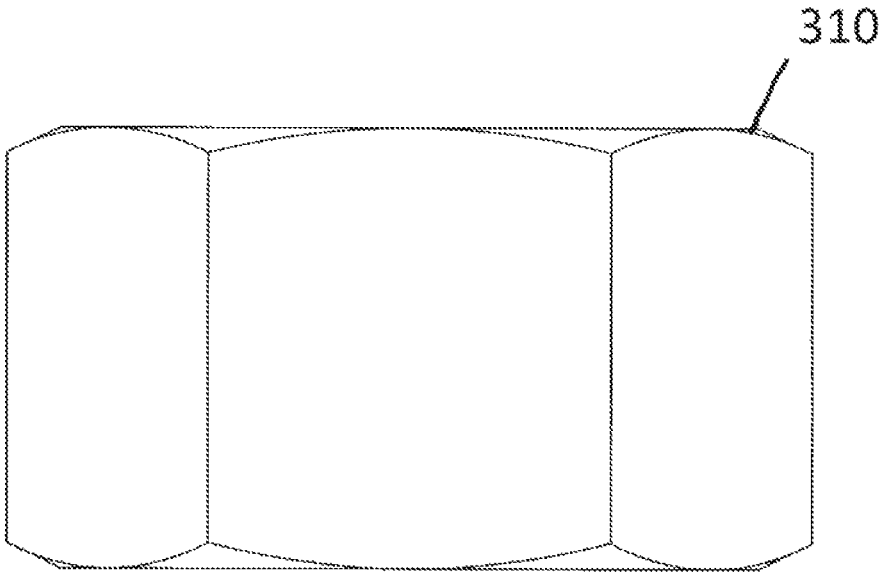
FIG. 5B illustrates a front view of the embodiment of the nut shown in FIG. 5A.

FIGS. 5A and 5B illustrate the nut 310 of the breakaway clamp 300 that screws onto the anchor bolt 315. As shown in FIG. 3B, the nut 310 may be tightened onto the anchor bolt 315 to directly contact the upper surface of the clamp body 305. The nut 310 may be a standard hex nut or a special hex nut that is specifically manufactured to possess an outer dimension smaller than the width (or inner dimension) of the slot 130. Sizing the nut 310 to be smaller than the slot 130 may beneficially allow the nut 310 to pass through the slot 130 when the lateral breakaway flanges 405 are severed (e.g., break, rupture, are torn away, etc.). Therefore, in some embodiments where the slot 130 has a width of 1¼", it may be helpful to ensure that the nut 310 has an outer dimension of 1" or less. For example, a special ¾" hex nut with a 1" dimension across the flats of the hex nut may be specifically used.

The installation and operation of the breakaway clamp 300 may be as follows. First, the clamp body 305 may be installed or mounted onto a slot 130 within the interior of the base 110 of the light pole 100. The anchor bolt 315 passes through the thru-hole 420 of the clamp body 305 and the nut 310 threads onto the anchor bolt 315 to tighten against the top surface of the clamp body 305. The breakaway clamp 300 is thus in the installed position shown in FIG. 3B. Although the depiction in FIG. 3B shows a single breakaway clamp 300 mounted on the base 110, as discussed above several breakaway clamps 300 (e.g., four) may be installed.

The material(s) and dimensions of the breakaway clamp 300 are specifically selected to ensure that the breakaway clamp 300 meets the tensile load requirements for the light pole 100. When a collision event occurs (e.g., a car strikes the light pole 100), however, the breakaway clamp 300 is configured so that the two lateral breakaway flanges 405 will sever (e.g., break, rupture, be torn away, etc.) from the tapered main body 400 of the clamp body 305. The tapered main body 400, the nut 310, and the anchor bolt 315 may thereafter pass through the slot 130 so that the base 110 of the light pole 100 can break away from the anchor bolt(s) 315. In this manner, the light pole 100 can be severed/ruptured from its foundation when a predetermined force (or higher) is applied. The light pole 100 can also be severed/ruptured from its foundation in a controlled manner based upon the designed/controlled breaking of the two lateral breakaway flanges 405.

The above-described breakaway clamp 300 may be specifically designed to be compatible with the 76996 Arlen base and the 12500 York base. One embodiment of the breakaway clamp 300 may possess an overall height dimension of 0.705", a length dimension (i.e., the outer dimension of the two lateral breakaway flanges) of 2.000", a tapered main body outer dimension spanning from 1.125" (at the top of the tapered main body) to 0.875" (at the bottom of the tapered main body), and a thru-hole with a 0.781" inner diameter. A tolerance of +/−0.01" could be used. This particular embodiment may be formed (e.g., extruded) using Aluminum Alloy 6061-T6. The breakaway clamp disclosed in this application, however, is not limited to any specific materials and/or dimensions.

While various exemplary embodiments of the disclosed system and method have been described above it should be understood that they have been presented for purposes of example only, not limitations. It is not exhaustive and does not limit the disclosure to the precise form disclosed. Modifications and variations are possible in light of the above teachings or may be acquired from practicing of the disclosure, without departing from the breadth or scope.

What is claimed is:

1. A breakaway pole comprising:

an elongated pole body extending between a bottom end and an upper end;

a base connected to the bottom end of the elongated pole body, the base comprising an interior flange having at least one slot; and a breakaway clamp mounted on the at least one slot of the interior flange of the base, the breakaway clamp comprising a nut and a clamp body, the clamp body comprising a tapered main body and two lateral breakaway flanges, the tapered main body possessing an upper portion and a lower portion, the lower portion of the tapered main body being positioned within the at least one slot of the interior flange of the base, the two lateral breakaway flanges extending laterally outward from the upper portion of the tapered main body so that the two lateral breakaway flanges contact the interior flange of the base laterally beyond the at least one slot.

2. The breakaway pole according to claim 1, wherein the elongated pole body is tapered between the bottom end to the upper end, the bottom end of the elongated pole body possessing a larger outer diameter than the upper end of the elongated pole body.

3. The breakaway pole according to claim 2, further comprising a light structure connected to the upper end of the elongated pole body.

4. The breakaway pole according to claim 1, wherein the at least one slot comprises a plurality of slots which are equally spaced apart from one another around the interior flange of the base, the plurality of slots each being u-shaped.

5. The breakaway pole according to claim 1, wherein the breakaway clamp is aluminum.

6. The breakaway pole according to claim 1, wherein the elongated pole body comprises an anchor bolt that extends through an interior of the clamp body to threadedly engage the nut.

7. The breakaway pole according to claim 1, a connection point between the clamp body and each of the two lateral breakaway flanges is chamfered.

8. The breakaway pole according to claim 1, wherein the base is cylindrical.

9. A breakaway clamp comprising:

a main body comprising a thru-hole, the main body possessing an upper portion and a lower portion, the lower portion of the main body being positionable within a slot of an interior flange of a base of a roadside structure;

at least one lateral breakaway flange extending laterally outward from the upper portion of the main body so that the at least one lateral breakaway flange is configured to contact the interior flange of the base laterally beyond the slot when the lower portion of the main body is positioned within the slot of the base; and a nut configured to tighten the clamp body onto an anchor bolt that extends through the thru-hole of the main body.

10. The breakaway clamp according to claim 9, wherein the main body is tapered so that an outer dimension of the main body gradually decreases from the upper portion to the lower portion of the main body.

11. The breakaway clamp according to claim 9, wherein the at least one lateral breakaway flange consists of two lateral breakaway flanges.

* * * * *